United States Patent [19]

Pivonka

[11] Patent Number: 4,741,323

[45] Date of Patent: May 3, 1988

[54] SPACE HEATER

[76] Inventor: Ralph M. Pivonka, 915 Maple, LaCrosse, Kans. 67548

[21] Appl. No.: 946,441

[22] Filed: Dec. 23, 1986

[51] Int. Cl.[4] ..... F24C 3/00

[52] U.S. Cl. ..... 126/85 R; 126/39 E; 126/59.5; 126/59; 126/214 R; 431/350; 431/354

[58] Field of Search ..... 126/67, 85 R, 33, 59.5, 126/37 A, 59, 39 H, 39 N, 39 J, 39 K, 271.1, 271.2 R, 39 E, 214 R, 214 D; 99/422, 447; 431/326, 336, 338, 340, 350, 354

[56] References Cited

U.S. PATENT DOCUMENTS

| | | | |
|---|---|---|---|
| 2,855,919 | 10/1958 | Prim | 126/85 R |
| 2,953,364 | 9/1960 | Reintjes . | |
| 2,955,590 | 10/1960 | Edwards, Jr. et al. . | |
| 3,055,145 | 9/1962 | Lindsay . | |
| 3,542,373 | 11/1970 | Dirkes . | |
| 3,802,414 | 4/1974 | Lee | 431/350 X |
| 4,063,876 | 12/1977 | Schweiss . | |
| 4,570,610 | 2/1986 | Himmel | 126/39 H X |

*Primary Examiner*—Larry Jones

*Attorney, Agent, or Firm*—Henderson & Sturm

[57] ABSTRACT

A space heater which is generally rectangular in shape and which has a chamber inside which is generally square in cross section. This square shaped chamber has inlets along the bottom thereof and outlets along the top thereof. An improved burner assembly is disposed centrally on the bottom wall of the chamber housing and includes a vertically extending conduit having an opening in the top thereof. A first square plate is attached to the top of the vertically extending conduit and the first square plate is disposed generally horizontally and has a round opening in the center thereof for allowing a fuel and air mixture to exit therethrough. The first square plate has upwardly extending flanges on each edge thereof for directing flames upwardly and causing the flame to be of the same cross sectional shape as the chamber. A second square plate, smaller than the first square plate, is disposed just above the first square plate and is also horizontally disposed. Downwardly depending corners on the second square plate are welded to the first square plate above the round opening in the first square plate and the edges of the second square plate are oriented so that the outer edges of adjacent walls of the first and second square plates are at a forty-five degree angle with respect to each other, whereby the flame will tend to be spread evenly over the top of the first square plate.

5 Claims, 2 Drawing Sheets

Fig. 5
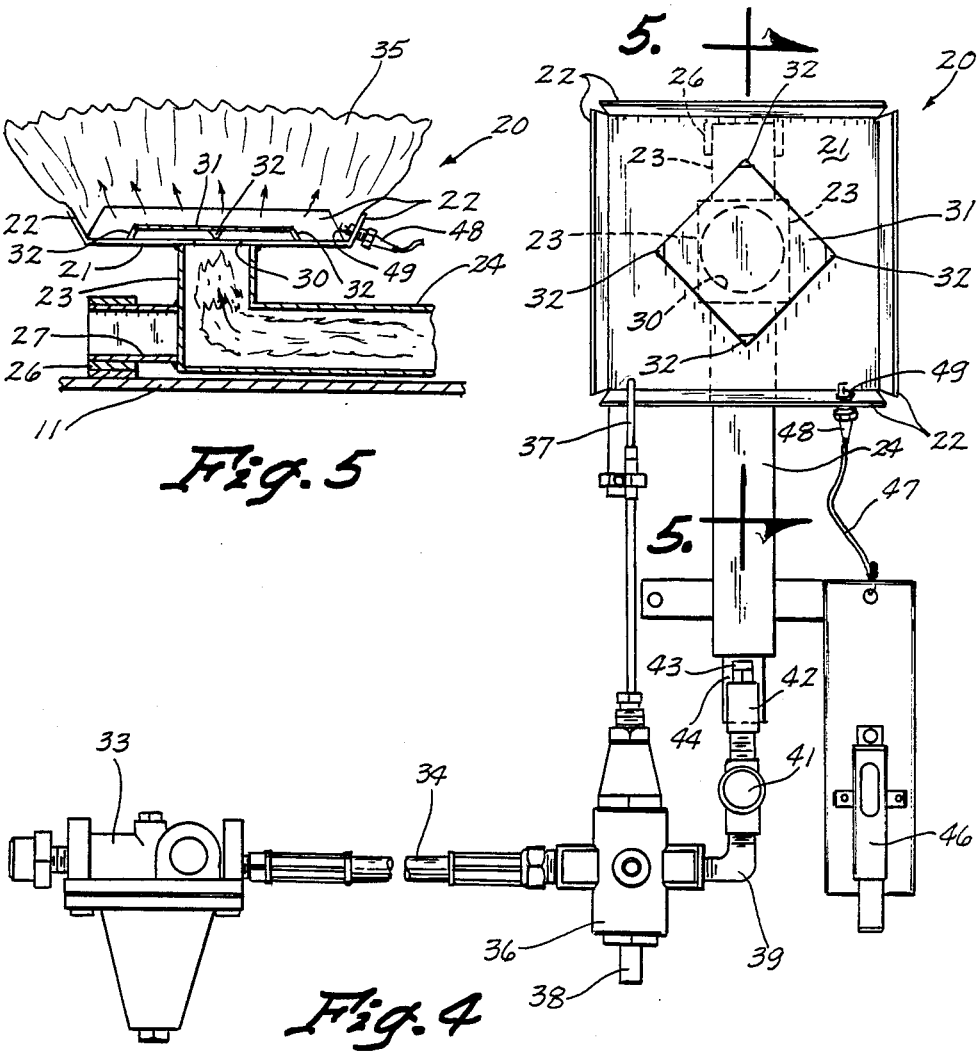
Fig. 4
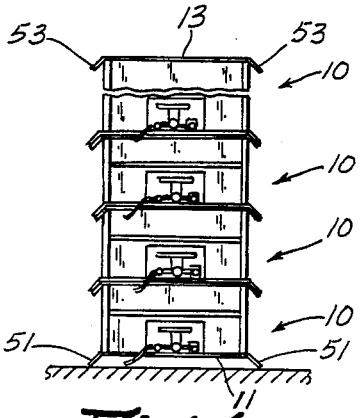
Fig. 6

SPACE HEATER

TECHNICAL FIELD

The present invention relates generally to a space heater, and more particularly to such a space heater adapted for the construction industry which includes an improved burner assembly.

BACKGROUND ART

Space heaters which are movable from place to place are common and well known in general. Such space heaters are in common usage in the construction industry for heating a confined space while construction is being completed. Usually these space heaters are somewhat cylindrical in shape and have an outlet near the top thereof for emitting heated air. A problem with such cylindrical heaters is that they do not emit the heated air downwardly where it is primarily needed. Also, they tend to tip over easily and they are generally of an awkward shape for use, storage or transportation purposes when moving such heaters from place to place. Consequently, there is a need for a low profile space heater which emits the air down low and which will overcome the other aforementioned problems as well.

DISCLOSURE OF THE INVENTION

The present invention relates generally to a space heater which is generally rectangular in shape and which has a chamber inside which is generally square in cross section. This square shaped chamber has inlets along the bottom thereof and outlets along the top thereof. An improved burner assembly is disposed centrally on the bottom wall of the chamber housing and includes a vertically extending conduit having an opening in the top thereof. A first square plate is attached to the top of the vertically extending conduit and the first square plate is disposed generally horizontally and has a round opening in the center thereof for allowing a fuel and air mixture to exit therethrough. The first square plate has upwardly extending flanges on each edge thereof for directing flames upwardly and causing the flame to be of the same cross sectional shape as the chamber. A second square plate, smaller than the first square plate, is disposed just above the first square plate and is also horizontally disposed. Downwardly depending corners on the second square plate are welded to the first square plate above the round opening in the first square plate and the edges of the second square plate are oriented so that the outer edges of adjacent walls of the first and second square plates are at a forty-five degree angle with respect to each other, whereby the flame will tend to be spread evenly over the top of the first square plate. The housing of the space heater is constructed so that the units are stackable one on top of another.

An object of the present invention is to provide an improved space heater.

Another object of the present invention is to provide a space heater which has a low profile.

A further object of the present invention is to provide a space heater which will resist tipping over.

A further object of the present invention is to provide a low profile space heater of the aforementioned type wherein several of such units are stackable for the convenience of storage and shipping.

A still further object of the present invention is to provide a space heater which has more radiating surface than a cylindrically shaped heater.

Other objects, advantages, and novel features of the present invention will become apparent from the following detailed description of the invention, when considered in conjunction with the accompanying drawings.

BRIEF DESCRIPTION OF THE DRAWINGS

FIG. 4 is an enlarged top plan view of the burner assembly showing the associated network to which it is attached;

FIG. 5 is an enlarged partial cross sectional view taken along line 5—5 and showing the burner assembly in use; and FIG. 6 is a front elevational view showing how several of the units of the preferred embodiment can be stacked one on top of another for storage or shipping purposes.

BEST MODE FOR CARRYING OUT THE INVENTION

Figure 1:
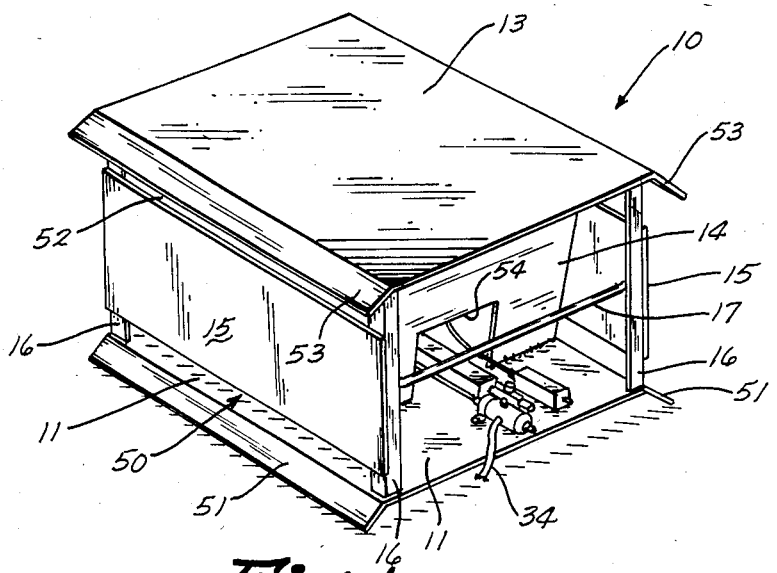
FIG. 1 is a perspective view of a space heater constructed in accordance with the present invention.

Referring now to the drawings, wherein like reference numerals designate identical or corresponding parts throughout the several views, FIG. 1 shows a space heater (10) constructed in accordance with the present invention.

The space heater apparatus (10) has a housing including a bottom wall (11), a rear wall (12), a top wall (13), a front wall (14) and sidewalls (15). The walls (11–15) are all interconnected together by being welded or otherwise fastened to corner braces (16) to form a rigid unit. A handle (17) is rigidly attached to the front braces (16) for carrying the space heater (10) from place to place.

A burner assembly (20) is positioned in the center bottom portion of the substantially square in cross section shaped chamber formed by the walls (11–15) and are aligned to that the edges of a square plate (21) having upwardly and outwardly extending flanges (22) are generally parallel to the adjacent walls of the square chamber.

The burner assembly (20) includes an upwardly extending conduit (23) which is generally square in cross sectional shape and which is attached to a similarly shaped conduit (24) which is generally horizontally extending. The bottom wall (11) has a tubular shaped member (26) welded thereto for telescopingly receiving a square tubular member (27). By sliding the burner assembly tube (27) into the tubular member (26), the burner is held in its proper position in the housing chamber and is still removable for service when such is needed.

The square plate (21) has a second square plate (31) overlying an opening (30) in the center of the first square plate (21). The corners (32) of the second square plate are bent downwardly and are welded to the top of the first square plate (21) in the orientation shown in FIG. 4.

Fuel, such as vaporous propane, is directed to the burner assembly (20) by first going through a preset pressure regulator (33) which is connected to a line (34) leading to a safety valve (36). The safety valve (36) is of a type having a thermocouple (37) connected thereto and a biased closed valve leading to button (38). An elbow (39) leads to a flame adjustment valve (41) through a nozzle (42) having an orifice (43) in one end thereof. This nozzle (42) is welded to a plate (44) to direct the fuel into the open end of tube (24) and when such fuel enters tube (24), primary air for combustion will enter around the exterior of orifice (43) where it enters the open end of conduit (24).

A piezo electric igniter (46) will send electricity through a wire (47) to a common automobile type spark plug (48) to cause a spark between contacts (49) for igniting the fuel on top of the first square plate (21) of the burner (20).

Figure 2:
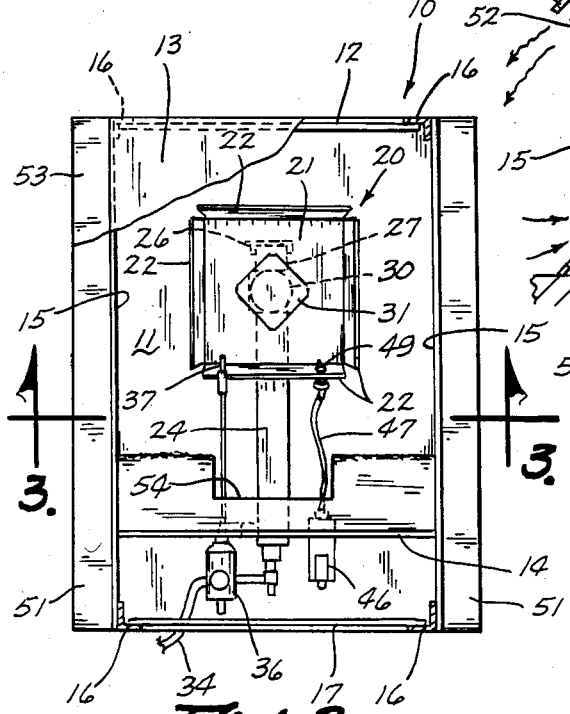
FIG. 2 is a top plan view of a preferred embodiment of the present invention as shown in FIG. 1, and having a portion of the top wall thereof removed to show the placement of the burner assembly therein.
Figure 3:
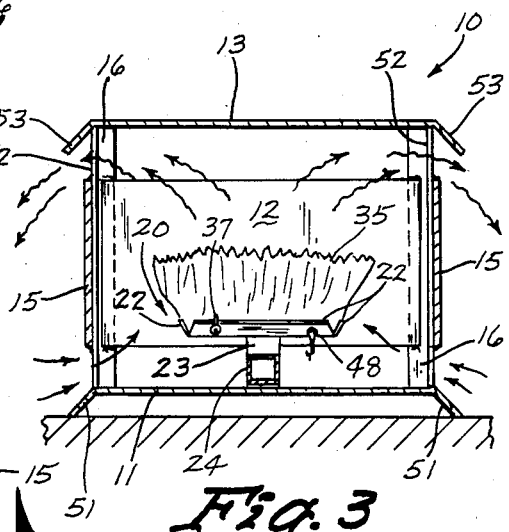
FIG. 3 is a cross sectional view taken along line 3—3 of FIG. 2.

In operation, the burner assembly (20) would be in the position shown in FIGS. 1, 2 and 3 and the unit would be placed on a floor to be used. A supply of vaporous propane in a tank (not shown) would be connected to the pressure regulator (33) and the unit could be lit in a similar fashion that a home furnace is lit. Specifically, the button (38) could be depressed to open up the safety valve (36) and the igniter (46) activated to cause a spark across contacts (49) just after the fuel passes through the opening (30) on top of the burner plate (21). This will cause the burner assembly (20) to flame in the manner shown in FIG. 5. The shape of the first square plate (21) and its side flanges (22) will cause the flame (35) to be substantially square in cross section to conform to the square shape of the chamber within the housing of the space heater (10). By having a square flame, the heat will be evenly distributed to the walls of the square chamber and will eliminate hot and cold spots within the chamber and on the housing.

The plate (31) on top of the plate (21) is of a square configuration, but it is turned so that the edges thereof are at a forty-five degree angle with respect to the edges of the flanges (22) on the first square plate (21). The purpose of this orientation is to allow the fuel and air coming to of opening (30) to have unobstructed passage to the corners where adjacent flanges (22) meet, since these corners are further away from the circular opening (30) than are the central portions of the flanges (22). The turned down corners (32) will slightly obstruct passage of the fuel and air mixture to the central portions of the upstanding flanges (22) and this will balance out the fact that the fuel air mixture does not need to be so concentrated there and consequently, a balance will be achieved along the entire length of each of the flanges (22) in terms of having an even flame and producing a substantially square flame in cross section.

When the burner assembly (20) is in use as shown in FIG. 1, air will enter inlet openings (50) over the top of downwardly depending flanges (51) attached to the bottom wall (11). As this air is heated up by the flame (35) of the burner assembly (20), it will rise by convection and exit out of the top through outlet opening (52). The air will then be directed downwardly by flanges (53) attached to the top side edges of the top wall (13).

An opening (54) in the front wall (14) allows for access to the burner assembly (20) when it is desired to remove the burner unit (20) for maintenance of the like. The bottom of the front wall (14) is spaced from the rear wall (12) by approximately the same distance that the sidewalls (15) are apart, producing a generally square in cross sectional shaped chamber for the burner (20). The front wall (14) is spaced further from the rear wall (12) at the top, than at the bottom thereof for helping to direct the heat upwardly as it expands and also to keep heat off of the parts that are attached to the burner unit (20) which can be seen in FIG. 1 extending out from the opening (54).

Referring to FIG. 6, it it noted that the top wall (13) and its downwardly depending flanges (53) are of substantially the same shape as the bottom wall (11) with its downwardly depending flanges (51) so that the space heaters (10) can be stacked, one on top of the other, in a stable fashion for storage or shipping.

Obviously, many modifications and variations of the present invention are possible in light of the above teachings. It is therefore to be understood that, within the scope of the appended claims, the invention may be practised otherwise than as specifically described.

I claim:

1. A heater apparatus comprising:

a housing having a substantially flat bottom wall, a substantially flat top wall parallel to said bottom wall, a pair of substantially vertical sidewalls, a rear vertical wall and a non-vertical front wall, the bottom of said front wall being closer to the rear wall than the top thereof is to the rear wall, the distance between the bottom of the front wall and the rear wall being substantially the same as the distance between the sidewalls;

a burner assembly disposed centrally on top of the bottom wall of said housing, said burner assembly comprising:

a vertically extending conduit having an opening in the top thereof;

a first square plate attached to the top of said vertically extending conduit, said first square plate being disposed parallel to the bottom wall of the housing, a round opening disposed in the center of said first square plate for allowing a fuel and air mixture to exit therethrough from said vertically extending conduit, said first square plate having a plurality of upwardly extending flanges attached to each edge thereof for directing the flames upwardly;

a second square plate smaller than the first square plate, said second square plate being flat and parallel to the first square plate except for downwardly extending corners which are rigidly attached to said first square plate, said second square plate being oriented so that the outer edges of adjacent walls of the first and second square plates are at a forty-five degree angle with respect to each other whereby the flame will tend to be spread evenly over the top of said first square plate;

means for supplying a fuel and air mixture to said vertically extending conduit;

means for igniting the fuel air mixture passing over the top of said first square plate;

air inlet opening means disposed between said sidewalls and said bottom wall of the housing for permitting cold air to enter said housing; and air outlet opening means disposed between said top wall and said sidewalls of said housing for permitting heated air to exit said housing.

2. The heater apparatus of claim 1 wherein said front wall has an opening in the bottom thereof for providing access to said burner assembly and for permitting a fuel supply line to extend to said burner assembly.

3. The heater apparatus of claim 1 including downwardly extending flanges attached to said top wall above said air outlet opening means for directing air downwardly from said outlet opening means.

4. The heater apparatus of claim 3 wherein said bottom wall has downwardly extending flanges thereon just below said air inlet opening means for directing air upwardly from a floor, and said bottom wall and its downwardly extending flanges being of substantially the same shape as said top wall and its downwardly extending flanges whereby an identical heater apparatus can be telescopically stacked together for storage or shipping.

5. The heater apparatus of claim 1 wherein said igniting means includes an automative type spark plug extending into a space just above said first square plate.

* * * * *